US007179856B2

(12) United States Patent
Park et al.

(10) Patent No.: US 7,179,856 B2
(45) Date of Patent: Feb. 20, 2007

(54) PHOTOLUMINESCENT GOLF BALL

(75) Inventors: Yang Hwan Park, Seoul (KR); Kyung Jung Kang, Kyoenggi-do (KR); Gwang Hee Lee, Kyoenggi-do (KR); Jung Gyu Moon, Tigard, OR (US); Chun Bae Ryu, Seoul (KR)

(73) Assignee: Fantom Company, Ltd., Seoul (KR)

( * ) Notice: Subject to any disclaimer, the term of this patent is extended or adjusted under 35 U.S.C. 154(b) by 41 days.

(21) Appl. No.: 10/838,386

(22) Filed: May 4, 2004

(65) Prior Publication Data

US 2004/0266554 A1 Dec. 30, 2004

(51) Int. Cl.
*A63B 37/00* (2006.01)
*A63B 37/12* (2006.01)
*A63B 37/14* (2006.01)

(52) U.S. Cl. ..... 524/430; 524/403; 524/420; 524/433; 523/210; 473/385; 473/371; 252/301.36; 252/301.4 R

(58) Field of Classification Search ..... None
See application file for complete search history.

(56) References Cited

U.S. PATENT DOCUMENTS 5,330,195 A * 7/1994 Gulick ..... 473/200
5,744,233 A * 4/1998 Opitz et al. ..... 428/328
5,989,135 A 11/1999 Welch
6,037,419 A 3/2000 Takesue et al.
6,130,294 A 10/2000 Ichikawa et al.
6,375,864 B1 * 4/2002 Phillips et al. ..... 252/301.33
6,755,912 B2 * 6/2004 Brown et al. ..... 118/500
2003/0109329 A1 6/2003 Kennedy

FOREIGN PATENT DOCUMENTS

AU 198432517 * 3/1986
JP 2000084115 * 3/2000
WO WO-92/15373 * 9/1992

OTHER PUBLICATIONS

Camel Chemical, Website Publication, 6 pages, Dec. 29, 2003.

* cited by examiner

*Primary Examiner*—David J. Buttner
(74) *Attorney, Agent, or Firm*—J. Bennett Mullinax, LLC

(57) ABSTRACT

Disclosed is a photoluminescent golf ball with a one- or multi-piece structure, which comprises an encapsulated photoluminescent composition. The golf ball is clearly visualized at night and under overcast conditions, so that it can be easily found where it lands after tee shots or fairway shots. Additionally, the golf ball has excellent mechanical properties including surface smoothness, driver distance and strength, and offers improved luminescent properties including brightness and decay luminance. Additionally, the photoluminescent pigment has better physical and chemical compatibility with constituent materials of a golf ball, providing a more durable ball than is achieved with conventional photoluminescent pigments.

10 Claims, 3 Drawing Sheets

PHOTOLUMINESCENT GOLF BALL

PRIORITY APPLICATION

This application claims the benefit of the Republic of Korea application having serial number 10-2003-0042816 filed on Jun. 27, 2003, and which is incorporated herein by reference.

BACKGROUND OF THE INVENTION

1. Field of the Invention

The present invention relates to a photoluminescent golf ball which can be clearly visualized at night as well as during cloudy or low light conditions. The photoluminescent golf ball has excellent physical performance characteristics and exhibits an extended duration of luminescence under night or low light conditions. More particularly, the present invention relates to a photoluminescent golf ball which can be easily seen both in flight and on the course due to its clear luminescence. In comparison to conventional luminescent golf balls, the balls of the present invention demonstrate superior driver distance, durability, persistent luminescence, and improved shelf life.

2. Description of the Prior Art

The sport of golf has become extremely popular. In recent years, the rise in popularity of international, professional players has contributed to the popularity of the sport in many countries that have not historically been associated with the sport. To accommodate the increased number of golfers, personal schedules, or time preferences, golf is occasionally held after sunset or before sunrise under artificial course lighting. In these times, although there is lighting, it is difficult to visually follow the golf ball's flight after tee shots or fairway shots because of the low light. Frequently, the golf players cannot find the golf balls, creating course delays. Such delays are costly to the course operators. Further, lost balls are both an unwelcome expense and a frustration for the golfer who incurs a penalty for a lost ball.

To solve these problems, there have been developed golf balls which comprise luminescent compounds which glow following exposure to U.V. or other light. However, most of the conventional golf balls developed for night games are disadvantageous in the following aspects. When the luminescent compounds are coated on golf balls by spraying, the compounds are not durable and wear off during play. When certain luminescent compounds, such as $Al_2O_3$ based photoluminescent materials, are mixed with a cover resin, a large amount of the compounds are needed, deteriorating the strength of the resulting golf balls.

In addition, conventional luminescent compounds are weak in brightness, chemical resistance, and weather resistance, as well as showing a short luminous time period. Accordingly, conventional luminescent golf balls suffer from the disadvantage of poor strength and short driver distance. Further, the photoluminescent pigment used in many conventional golf balls are highly alkaline and are thus vulnerable to moisture damage and promote the aging of the resin of golf balls, thus reducing the life span of the golf balls.

Another prior art ball uses a clear, solid golf ball construction with a quarter-inch diameter hole defined through the ball, whereby a night light stick of about a quarter-inch diameter is inserted to artificially light the ball. This type of ball causes improper balance, thus affecting the ball's flight symmetry while also yielding shorter flight distance performance. Accurate putting is also impaired by the off-balance ball. The light stick is replaced with a new stick once the luminescence fades.

SUMMARY OF THE INVENTION

It is an aspect of at least one embodiment of the present invention to provide a luminescent golf ball which may be clearly seen at night and in low light conditions.

It is a further aspect of at least one embodiment of the present invention to provide for a luminescent golf ball in which the luminescent golf ball has improved luminescent properties and strength properties compared to prior art luminescent balls.

It is another aspect of at least one of the present embodiments of the invention to provide a photoluminescent golf ball in which the photoluminescent material is present in an encapsulated form within either the cover or clear top coat of the golf ball.

In accordance with one aspect of at least one embodiment of the present invention, an improved photoluminescent golf ball may be provided in which either an outer cover or one or more clear top coats of the golf ball comprises an encapsulated photoluminescent composition which is prepared by encapsulating the photoluminescent composition with maleic anhydride-grafted polypropylene, an effective amount of the photoluminescent composition comprising about 55 to about 62.5 wt % of strontium oxide, about 35 to about 42.5 wt % of the aluminum oxide $AL_2O_4$, about 1 to about 9 wt % of dysprosium oxide and about 0.5 to about 1.5 wt % of europium oxide plus about 0.02 to about 0.06 mol % of dysprosium and 0.001–0.005 mol % of nickel.

In an additional embodiment of the present invention, there is provided a photoluminescent golf ball which has a two-piece structure consisting of a core, a cover provided with a number of dimples thereon, enclosing the core, and a transparent coat on the cover, wherein the encapsulated photoluminescent composition is contained in the amount of about 0.1 parts per hundred (PPH) to about 5% PPH in the cover and/or the transparent coat.

In yet an additional embodiment of the present invention there is provided a photoluminescent golf ball which has a multi-piece structure consisting of a core, having an inner cover injection molded around the core. An outer cover is applied to an exterior of the inner cover wherein the encapsulated photoluminescent composition is contained in the outer cover and/or a transparent coating such as a clear primer or a clear top coat layer.

These and other features, aspects, and advantages of the present invention will become better understood with reference to the following description and appended claims.

BRIEF DESCRIPTION OF THE DRAWINGS

A fully and enabling disclosure of the present invention, including the best mode thereof, to one of ordinary skill in the art, is set forth more particularly in the remainder of the specification, including reference to the accompanying drawings.

DETAILED DESCRIPTION OF THE PREFERRED EMBODIMENT

Figure 1:
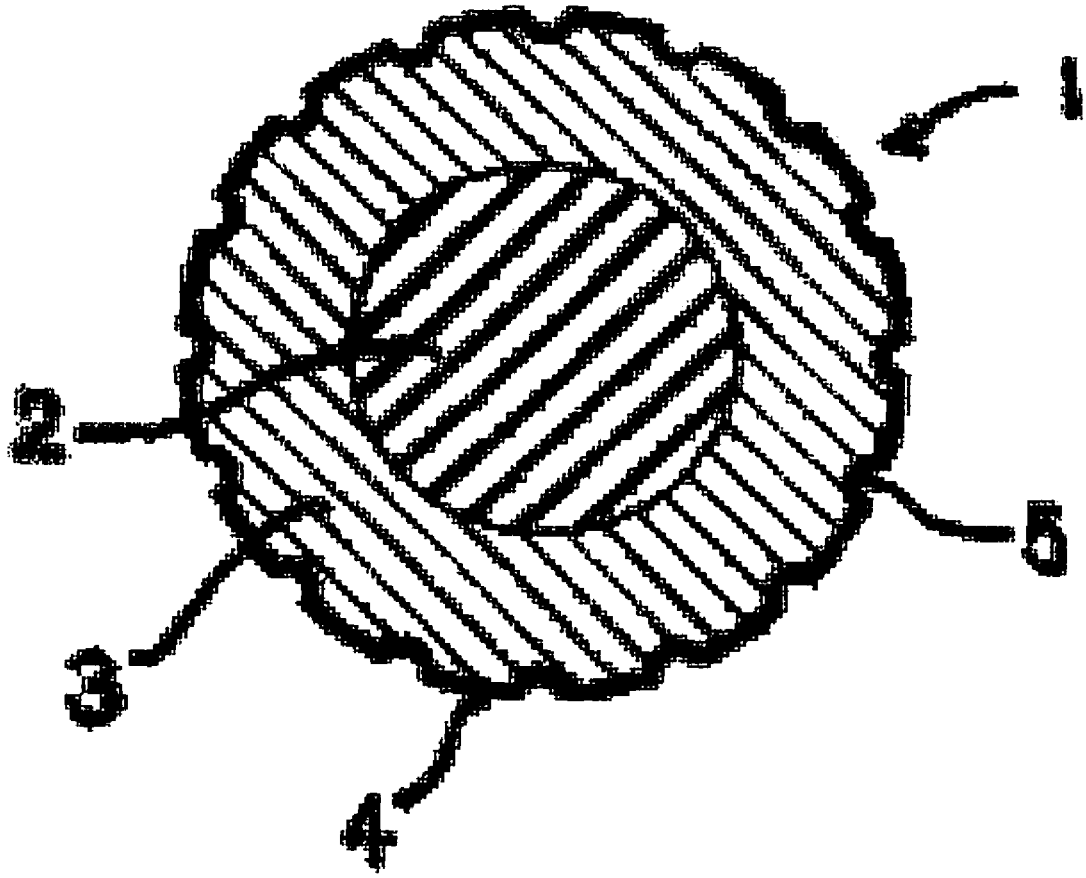
FIG. 1 is a cross-sectional view showing the structure of a two-piece golf ball in accordance with an embodiment of the present invention.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus or process pathway. To avoid redundancy, detailed descriptions of much of the apparatus once described in relation to a figure is not repeated in the descriptions of subsequent figures, although such apparatus or process is labeled with the same reference numbers.

The present invention is directed to a photoluminescent golf ball which shows excellent physical properties and can give a clear visual trace when flying in the night as well as in cloudy or low light conditions. The golf balls of the present invention are comparable to conventional top quality balls in driver distance and strength. Further, the balls exhibit superior luminescent time, brightness, and are compatible with golf ball cover formulations.

In the golf ball of the present invention, a photoluminescent composition is present in at least one of an exterior cover layer or a clear primer layer or top coat layer applied to the cover. The photoluminescent compound is less alkaline than other photoluminescent compounds and additionally contains dysprosium and nickel to offer improved pH control when added to an ionomer cover material. In one preferred embodiment, the photoluminescent composition comprises strontium oxide in the amount of about 55.0 to about 62.5 wt %, an aluminum oxide, $Al_2O_4$, in the amount of about 35.0 to about 42.5 wt %, dysprosium oxide in the amount of about 1.0 to about 9.0 wt %, europium oxide in the amount of about 0.5 to about 1.5 wt %, dysprosium in the amount of 0.02–0.06 mol % and nickel (Ni) in the amount of about 0.001 to about 0.005 mol %.

A yellow photoluminescent composition may be provided that includes strontium oxide in the amount of about 55.0 to about 62.5 wt %, an aluminum oxide, $Al_2O_4$, in the amount of about 35.0 to about 42.5 wt %, dysprosium oxide in the amount of about 1.0 to about 9.0 wt %, and europium oxide in the amount of about 0.5 to about 1.5 wt %. A modification of this photoluminescent composition can provide a variety of luminescent colors for golf balls. For example, a composition comprising strontium oxide in the amount of about 20.0 to about 68.75 wt %, an aluminum oxide, $Al_2O_4$ in the amount of about 30.0 to about 78.75 wt %, calcium oxide in the amount of about 0.1 to about 49.75 wt %, dysprosium oxide in the amount of about 0.1 to about 49.75 wt %, europium oxide in the amount of about 0.1 to about 49.75 wt %, and silicon dioxide in the amount of about 0.05 to about 48.8 wt % shows blue luminescence.

Red luminescence can be obtained in the composition comprising calcium sulfide in the amount of about 70.00 to about 98.85 wt %, calcium sulfate in the amount of about 1.00 to about 29.85 wt %, europium oxide and/or thulium oxide in the amount of about 0.05 to about 28.9 wt %, and silicon dioxide in the amount of about 0.1 to about 28.95 wt %. Accordingly, golf balls to which these compositions are applied show various luminescent colors (red, green blue, etc.) at night or in the dark.

Prior art photoluminescent compositions, such as those based on an $Al_2O_3$ chemistry, are susceptible to moisture and produce elevated pH levels. Thus, when being combined with golf ball resins, prior art photoluminescent compositions will adversely affect the durability of golf balls. The inclusion of dysprosium and nickel in small amounts has been found to render an improved pH environment when formulated into a golf ball cover. In the formulations above, dysprosium (0.02 to 0.06 mol %) and nickel (0.001 to 0.005 mol %) fine particulates have been found to be an effective amount of additives to control alkalinity in an ionomer golf ball cover. The presence of these elements results in a considerable decrease in alkalinity, so that the photoluminescent composition (e.g., EZ 25 manufactured by EZ Bright, Japan) is now more resistant to water. That is, the golf balls employing the water-resistant photoluminescent composition are improved in durability.

Figure 3:
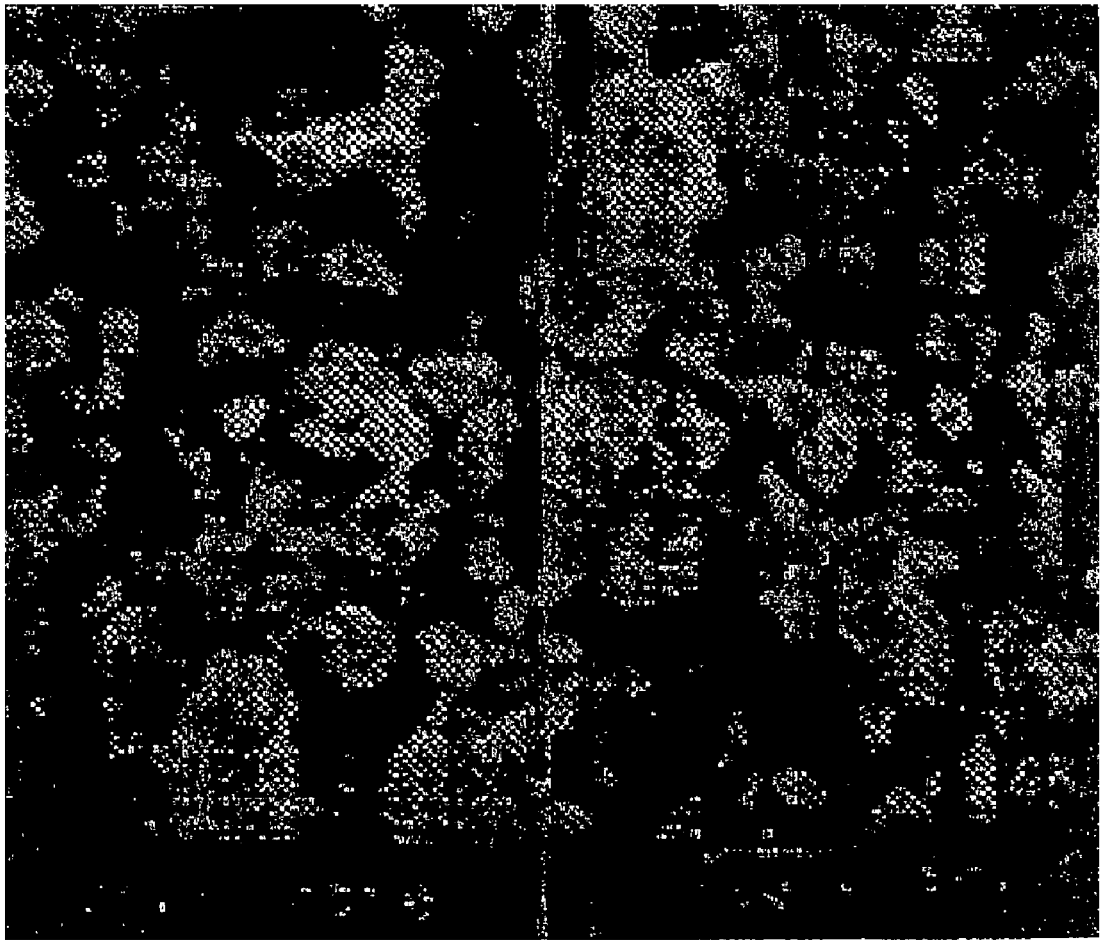
FIG. 3 is a microphotograph showing the particle size and shape of the photoluminescent pigment used in the present invention prior to encapsulation.

With reference to FIG. 3, there are shown particles of a photoluminescent composition. As seen in the photograph of FIG. 3, the photoluminescent composition particles have rough surfaces. Golf balls employing these coarse particles are poor in quality. Additionally, the rough photoluminescent composition particles may transform the otherwise smooth dimple surfaces and adversely affect the flight performance of the golf balls.

The photoluminescent composition particles used in the present invention are surface-revised by encapsulation. The encapsulation process uses a phase separation process, called complex coacervation, in which maleic anhydride-grafted polypropylene (MAH-PP) is used as a wall material. For example, MAH-PP is completely dissolved at 125° C. in a first solvent, e.g., xylene and the photoluminescent composition (serving as a core material) is added to the solution with stirring. Thereafter, a second solvent, e.g., ethylene glycol monoethyl ether is dropwise added and the resulting solution is cooled to room temperature and stabilized for 12 hours at 0° C., followed by filtration. The resulting product comprises small particles of the photoluminescent composition which is encapsulated by a wall material of MAH-PP. The encapsulated wall material is in a powder form having a size of between about 10 to about 30 microns. The encapsulated powder provides for an improved finish and cover durability compared to the unencapsulated product.

In the present invention, the photoluminescent golf ball can be prepared by the application of the encapsulated photoluminescent compound to a component of the golf ball. The golf ball according to the present invention has substantially the same structure as in conventional golf balls. That is, the golf ball of the present invention may have a one-piece structure or multi piece structure. For example, the golf ball of the present invention may be a 2-piece or a 3-piece ball, or a higher-multi piece ball.

With reference to FIG. 1, there is shown the structure of a 2-piece golf ball 1 according to the present invention. As shown in FIG. 1, the 2-piece golf ball consists of a core 2, a cover layer 3 having a number of dimples 5 thereon, and a transparent polyurethane top coat 4 over the cover 3. Typically, the core 2 is made of a synthetic rubber of high resilience. Onto the core 2, the cover 3 is molded from an ionomer resin (e.g., sold in the trade name of Surlyn™ from DuPont U.S.A.) by a well-known technique, for example, injection molding. After being provided with dimples 5, the cover 3 may be coated with a transparent coating 4 including one or more clear primer layers an/or an outermost clear top coat layer. In one embodiment of the invention, the photoluminescent compound is homogeneously mixed with the ionomer resins used for the golf ball cover, and the mixture with photoluminescent compounds is molded into a cover layer using well known injection molding techniques. Alternatively, the photoluminescent compound may be mixed with one or more of the transparent coatings such as a clear primer or a polyurethane sealant as are commonly used to coat golf balls.

Figure 2:
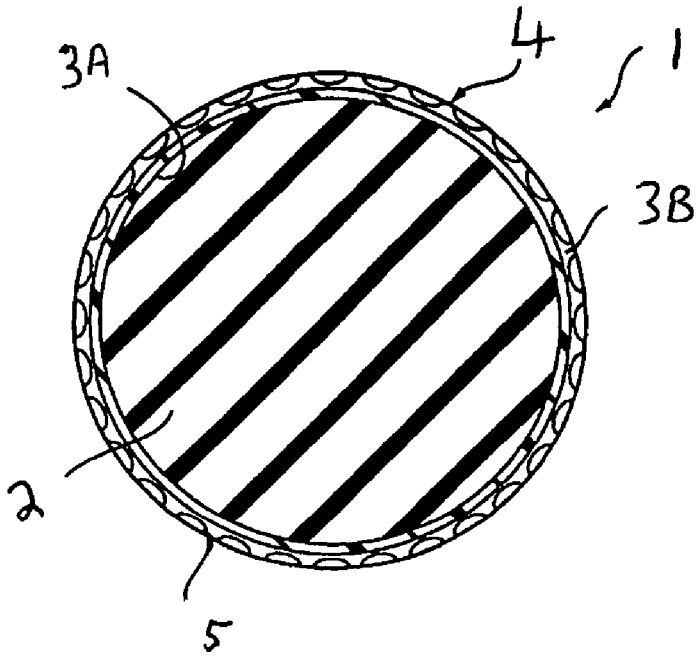
FIG. 2 is a cross-sectional view showing the structure of a three-piece golf ball in accordance with an embodiment of the present invention.

As seen in reference to FIG. 2, a 3-piece ball is illustrated having a conventional core 2 having an inner cover layer 3A and an outer cover layer 3B. As is conventional within the art, dimples 5 are formed in the outer cover layer 3B and a transparent primer and top coat layers, indicated generally as transparent coating 4, may be applied over the outer cover 3B. In accordance with the present invention, the photoluminescent compound may be present in either the outer cover layer 3B or in one of the primer coats or clear top coat layer 4 applied to outer cover 3B.

The photoluminescent golf ball of the present invention is characterized in that the cover 3 or outer cover 3B and/or a transparent coat layer 4 contains the encapsulated photoluminescent composition to serve as a luminescent layer.

In one embodiment, the encapsulated photoluminescent composition may be uniformly dispersed in a cover layer for 2-piece golf balls, in an outer cover layer for 3-piece golf balls, or in a transparent coating layer applied to the exterior cover layer of 2-piece, 3-piece, or multi-piece balls. The incorporation of luminescent materials into a golf ball cover has been used with other photoluminescent materials as set forth in U.S. Pat. No. 5,989,135 and which is incorporated herein by reference. The above reference discloses certain Suryln™ resins which allow for a luminescent cover.

The photoluminescent golf ball 1 of the present invention may be a 2-piece structure as seen in FIG. 1 consisting of a core 2, a cover layer 3, with dimples 5 , and at least one transparent coat 4 on the cover layer, where the encapsulated photoluminescent composition is contained either in the cover or one or more of the transparent top coats. In this regard, the encapsulated photoluminescent composition is homogeneously mixed with a synthetic resin for golf ball cover, and the mixture is molded into a cover for golf balls by injection or pressing. Alternatively, the photoluminescent composition may be homogeneously mixed with a top coat applied to the surface of a golf ball.

While the present invention is disclosed with respect to some specific embodiments set forth below, the photoluminescent pigment may be applied in at least three different manners. For instance, the pigment may be mixed in with the cover materials so that the cover will exhibit photoluminescence. When the photoluminescent pigment is in the cover, a dear primer coat should be applied to the cover such as conventional water based non-pigmented primers. Following drying, any markings or pad printing which is desired can be done on the primer coated surface followed by coating the primer surface with a clear top coat. Typically, a clear top coat is a solvent based polyurethane coating which, in the present example, would not contain any additional pigments.

Optionally, a cover can be provided having conventional titanium dioxide or other white pigments present. Thereafter, the cover can be coated with a clear primer coat which includes the photoluminescent pigment. Following drying, any pad printing can be done on the dried primer coat which is then followed by a clear top coat. In this manner, the top coat helps protect the photoluminescent pigment present in the primer coat and does not mask or obscure the photoluminescent response properties of the resulting golf ball.

Yet an additional option is to provide for a typical pigmented cover for the golf ball and then coating with a primer coat which may include additional white pigments. Thereafter, the cover is pad printed with any markings that are desired and a clear top coat which includes an effective amount of the photoluminescent pigment is then applied. In this manner, a golf ball having a conventional white coloration may be provided in which the ball undergoes a photoluminescent response under the appropriate environmental stimulus.

In accordance with the present invention, a 3-piece ball may be provided as seen in reference to FIG. 2 in which the ball 1 has a conventional core 2 having an inner cover layer 3A and an outer cover layer 3B. As is conventional in the art, dimples 5 are formed on the outer cover layer 3B and a transparent top coat 4 may be applied over the outer cover 3B.

With respect to a cover addition, together with additives such as dispersants, the encapsulated photoluminescent composition is homogeneously mixed with an ionomer resin and the mixture is, for example, injection-molded at a uniform thickness on the core 2 to form the cover 3. As mentioned above, if the golf ball has a three-piece or more multi structure, the encapsulated photoluminescent composition is preferably contained only in the outer cover layer. The encapsulated photoluminescent composition contained in the cover layer ranges, in specific gravity, from about 3.7 to about 3.9 and which is higher than the specific gravity of the core. Accordingly, the specific gravity of the core is reduced to the same extent as that increased in the cover to meet the standard for officially approved balls (45.93 g). Suitable multi-piece golf ball covers, techniques, and formulations may be found in reference to U.S. Pat. No. 6,037,419 which is incorporated herein by reference. Such teachings in the reference may be modified in accordance with the present invention such that the cover 3 or outer cover 3B comprises a photoluminescent composition as referenced above.

Alternatively, the encapsulated photoluminescent composition may be uniformly mixed with a typical transparent composition, such as a clear primer or a polyurethane resin-based exterior coating composition. The mixture is then coated on the cover 3 by a conventional technique such as spraying. Frequently, the exterior coat is applied over a painted cover.

In accordance with the present invention, the cover 3, outer cover 3B, or the transparent top coat layer 4 preferably comprises the encapsulated photoluminescent composition in the amount of about 0.1 parts per hundred (PPH) to about 5.0 PPH; and more preferably about 1.0 PPH to about 5.0 PPH and still more preferably from about 1.0 to about 3.0 PPH. For example, when the encapsulated photoluminescent composition is used in an amount lower than about 0.1 PPH, the golf balls shows poor brightness at night. On the other hand, when the amount of the encapsulated photoluminescent composition exceeds 5.0 to 10.0 PPH, the golf ball is not further improved in brightness and may adversely affect desirable hardness, mechanical strength, and impact resistance properties.

EXAMPLES

Preparation of Core Ball

A synthetic rubber core composition used in Assignee's commercially available Power Distance™ ball was vulcanized at around 160° C. for 30 minutes in a typical mold to prepare a core ball for 2-piece golf ball, which measured 38.4 mm in diameter. It is believed that any conventional golf ball core composition may be used with the present invention.

Encapsulation of a Photoluminescent Composition

A photoluminescent encapsulated composition (sold in the brand name of EZ 25 by EZ Bright Corporation, Japan) comprising 57 wt % of strontium oxide, 39 wt % of the aluminum oxide $Al_2O_4$, 3.3 wt % of dysprosium oxide and 0.7 wt % of europium oxide plus 0.02–0.06 mol % of dysprosium and 0.001–0.005 mol % of nickel was encapsulated for surface revision. The photoluminescent composition consisted of 80% of globular particles and 20% of needle-like particles with an average particle size of 40 μm and measured 10–60 μm in particle distribution.

The photoluminescent composition was mixed in the ratio of 30:1 with maleic anhydride-grafted polypropylene (MAH-PP) which served as an encapsulation wall material. In this regard, MAH-PP was completely dissolved at 125° C. in a primary solvent such as xylene to which the photoluminescent composition was then added with stirring. To this solution, ethylene glycol monoethyl ether was added dropwise. Thereafter, the resulting solution was cooled to room temperature and stabilized to 0° C. for 12 hours, followed by filtration to produce an encapsulated photoluminescent composition.

Formation of Photoluminescent Cover

A typical cover resin composition of a 50:50 blend of a Surlyn™ 8940:9910 was mixed with the photoluminescent composition in the amounts and with the conventional additives as shown in Table 1. The resulting composition was molded into covers having a thickness of 2.3 mm onto the core by injection molding to form a 2-piece ball. After the formation of dimples on the covers, a conventional transparent top coat was applied to the covers to produce photoluminescent golf balls which measured 42.70 mm in diameter. Typically, two coats of clear finishes may be applied to the surface of a golf ball cover. The first coat is a clear, water-based primer coat and the second coat, comprising a clear, solvent-based top coat.

The ionomer 9910 is a clear ionomer which provides for a transparent cover. If desired, a cover made out of 100% 9910 ionomer may be used. When the 9910 ionomer is mixed with an 8940 ionomer, the cover is no longer transparent but remains translucent and allows for the activated photoluminescent compounds to be visualized. The values in the tables below are expressed in parts per hundred (phr) relative to the total constituents of the respective cover formulation or top coat formulation.

TABLE 1

| | Examples | | | | Comparative Ex. |
|---|---|---|---|---|---|
| Ingredients | 1 | 2 | 3 | 4 | 1 |
| Cover Resin Composition | 100 | 100 | 100 | 100 | 100 |
| Photoluminescent Comp. | 0.1 | 3 | 5 | 5 | — |
| Additives[1] | 1 | 1 | 1 | 1 | 1 |

Note.
[1]Additives: Ca lubricant, dispersant, antioxidant, etc.

Formation of Photoluminescent Transparent Coat

On the cover prepared with the composition of Comparative Example 1 of Table 1, (minus the photoluminescent material) compositions shown in Table 2, below, were sprayed to form photoluminescent transparent coats which were about 0.2 mm thick. Preferably, the photoluminescent composition is contained in the outermost urethane top coat. However, where multiple top coats are used, it is believed that the photoluminescent material may be contained in underlying clear coats and/or present in multiple coats.

TABLE 2

| | Examples | | | Comparative Ex. |
|---|---|---|---|---|
| Ingredients | 5 | 6 | 7 | 2 |
| Urethane top coat[1] | 100 | 100 | 100 | 100 |
| Curative | 7 | 7 | 7 | 7 |
| Encapsul. Photoluminescent Comp. | 0.1 | 3 | 5 | — |
| Dispersant | 1 | 1 | 1 | 1 |

Note
[1]manufactured by Dongju Industrial Co. Ltd., Korea

Test for Water Resistance

1. Test Method: Five grams of each of the photoluminescent composition (encapsulated) used in the present invention (Test Example 1) and a conventional photoluminescent composition based on an $Al_2O_3$ chemistry (high alkalinity) (Test Example 2) were dissolved in 100 ml of ionic water, and pH values of the solutions were traced according to time.

2. Results

TABLE 3

| | pH Value | | | | | | | | | | |
|---|---|---|---|---|---|---|---|---|---|---|---|
| | 1 min | 60 min | 120 min | 180 min | 240 min | 300 min | 360 min | 420 min | 480 min | 540 min | 600 min |
| Test 1 | 10.32 | 10.45 | 10.56 | 10.87 | 10.91 | 10.98 | 10.88 | 10.56 | 10.74 | 10.86 | 10.66 |
| Test 2 | 10.40 | 10.88 | 11.38 | 11.26 | 11.42 | 11.42 | 11.56 | 11.45 | 11.60 | 11.45 | 11.50 |

Note.
Ionic water pH 6.92, measured at 25.2° C.
Test 1: EZ 25 manufactured by EZ Bright, Japan
Test 2: Conventional photoluminescent composition 3. Analysis: As seen in the results, the pH values of the conventional photoluminescent composition were measured to be higher than those of the photoluminescent composition used in the present invention. It is believed the higher pH values of conventional photoluminescent compositions are attributable to hydroxides which are produced. High pH values resulted in a more rapid decay of the photoluminescent properties. Accordingly, golf balls made according to the present invention may exhibit a longer duration of useful photoluminescence as set forth and described below. Additionally, the lower pH values are believed to contribute to longer cover life in that the less alkaline photoluminescent compounds of the present invention are more compatible with the chemistry of conventional ionomer covers and exhibit less degradation in the presence of water.

Brightness and Luminescent Time

1. Method: The photoluminescent golf ball of Example 2 and a conventional photoluminescent golf ball were stored for 24 hours in a completely dark space. Afterward, light was illuminated at a right angle onto the golf balls from a 15-watt fluorescent lamp positioned at a distance of 40 cm above (about 1000 Lux). The golf balls were measured for brightness under the following conditions:

Temp. 25° C.

Humidity 65%

Exposure Time 20 min

Distance to golf balls 0.4 m

Measuring angle 90°

Measuring instrument LS-100 Luminance meter (Minolta, Japan)

For comparison, there was used a golf ball employing a conventional photoluminescent composition which is the most prevalent in the market.

2. Results

TABLE 4

| | Decay Luminance(mcd/m$^2$) Time (min) | | | | | | | | | | | | | | | | |
|---|---|---|---|---|---|---|---|---|---|---|---|---|---|---|---|---|---|
| | 1 | 5 | 10 | 20 | 30 | 40 | 50 | 60 | 120 | 180 | 240 | 300 | 360 | 420 | 480 | 540 | 600 |
| Test 1 | 2,112 | 629 | 333 | 166 | 108 | 78 | 61 | 50 | 22 | 14 | 10 | 8 | 6 | 6 | 5 | 4 | 4 |
| Test 2 | 2,080 | 610 | 315 | 151 | 94 | 75 | 58 | 47 | 19 | 12 | 9 | 7 | 5 | 4 | 3 | 3 | 2 |

3. Analysis: After 6 hours, the conventional golf ball could not be recognized with the naked eye because its brightness was reduced into a point lower than 5 mcd/M$^2$. According to DIN 97510, 5 mcd/M$^2$ is the lowest brightness at which humans can recognize an object with the naked eye. By contrast, the brightness of the sample golf ball of the present invention was maintained at 5 mcd/m$^2$ even after 8 hours. Therefore, the golf ball of the present invention is far superior in brightness and decay time to the conventional one. The 2 hour increase in visible photoluminescence makes it more likely a golfer can complete his round using the original photoluminescent ball.

Strength Test

1. Method: golf balls (Example 3 and Comparative Example 2) were repetitively jetted through a one-meter long pipe into a disk 10 cm in diameter (10° loft, groove formed as in iron club) by use of an air pressure of 0.75 kgf/cm$^2$. The durability of golf balls was expressed as a hit number until the golf balls were broken.

2. Result

TABLE 5

| Golf Balls | Hit No. |
|---|---|
| Comparative Ex. (general 2PC) | 130 |
| Example 4 | 130 |

Note:
measured with a durability tester

3. Analysis: The golf ball of the present invention, although comprising a photoluminescent composition, showed the same durability as in the conventional 2-piece ball.

As described hereinbefore, the golf balls of the present invention can be clearly visualized at night and in low light conditions. Thus, the golf balls can be easily tracked and found following tee shots or fairway shots. Accordingly, the golf balls of the present invention are more easily found and result in fewer lost balls.

In addition, the golf balls of the present invention are excellent in mechanical properties. Their surface roughness and driver distance are measured to be as good as those of conventional, non-photoluminescent golf balls. As for brightness and decay luminance, better values are measured in the golf balls of the present invention than in conventional photoluminescent golf balls. Because they employ encapsulated photoluminescent composition, the golf balls of the present invention are superior in chemical resistance and weather resistance to conventional photoluminescent golf balls.

Further, during flight, the golf balls of the present invention provide a visual, clear, bright color to enhance visibility in flight and improved visibility of the ball on the course.

While the embodiments described above are directed to a uniform dispersement of the photoluminescent pigments in the outer visible surface(s) of the golf ball, the photoluminescent pigment may also be used in a localized manner with respect to a golf ball. For instance, using a pad printing technique, a localized region or pattern of the photoluminescent pigments may be applied to a surface of a golf ball. The localized pigments may be in the form of a company logo, sponsorship, or other advertising. In this manner, when the ball is exposed to appropriate light, the logo of a ball manufacturer, sponsor, or paid advertiser will appear. To the extent the logo or other markings appear on multiple locations of the ball, such localized patterns would be visible without having to move the ball during play.

Alternatively, the photoluminescent pigments may be applied to either the cover or one of the transparent coats as described above. Thereafter, a logo or other marking can be applied in a black ink outline in which a center portion is applied in white ink. In this manner, the portion of the ball surrounding the logo will be photoluminescent while the white ink portion within or defining the logo provides a visible contrast which highlights the logo portion. The black ink applied as an outline or border, further accentuates the demarcation between the photoluminescent portion of the golf ball and the logo.

The teachings and features of the present invention directed to a luminescent golf ball may also combine with properties of other color changing golf balls. Assignee is the owner of co-pending U.S. patent applications having Ser. Nos. 10/838,397 and 10/838,387 directed to a "photochromic golf ball" and a "thermochromic golf ball" respectively and having a filing date identical to the filing date of the present application. The specification and figures of the Ser. Nos. 10/838,397 and 10/838,387 applications referenced above are incorporated herein by reference in their entirety. It is envisioned that it would be possible to combine the teachings of a thermochromic golf ball with the luminescent properties of the golf ball of the present invention so as to achieve a ball with various combinations of thermochromic, photochromic, and/or luminescent properties.

For example, a golf ball can be provided which may be responsive to UV radiation as described in Assignee's above referenced Ser. No. 10/838,397 application along with the luminescent properties of a golf ball according to the present invention. Accordingly, the various light changing pigments and luminescent pigments can be incorporated into the various cover, primer, and top coat layers of the golf ball or in association with pad printing ink applications so as to achieve a single golf ball having properties of two or more of the color change/light change properties.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

What is claimed is:

1. A photoluminescent golf ball, comprising an encapsulated photoluminescent composition, wherein the encapsulation photoluminescent composition has a wall material of maleic anhydride-grafted polypropylene, and a core composition is selected from the group consisting of a photoluminescent composition comprising 55–62.5 wt % of strontium oxide, 35–42.5 wt % of an aluminum oxide $Al_2O_4$, 1–9 wt % of dysprosium oxide and 0.5–1.5 wt % of europium oxide plus 0.02–0.06 mol % of dysprosium and 0.001–0.005 mol % of nickel; a photoluminescent composition comprising 20–68.75 wt % of strontium oxide, 30–78.75 wt % of an aluminum oxide $AL_2O_4$, 1–49.75 wt % of calcium oxide, 0.1–49.75 wt % of dysprosium oxide, 0.1–49.75 wt % of europium oxide and 0.05–48.8 wt % of silicon dioxide plus 0.02–0.06 mol % of dysprosium and 0.001–0.005 mol % of nickel; and a photoluminescent composition comprising 70–98.85 wt % of calcium sulfide, 1–29.85 wt % of calcium sulfate, 0.05–28.9 wt % of europium oxide and/or thulium oxide, and 0.1–28.95 wt % of silicon dioxide plus 0.02–0.06 mol % of dysprosium and 0.001–0.005 mol % of nickel.

2. The photoluminescent golf ball as defined in claim 1, wherein the photoluminescent golf ball has a two-piece structure consisting of a core, a cover provided with a number of dimples thereon enclosing the core, and at least one transparent coat applied to the cover, the encapsulated photoluminescent composition contained in at least one of said cover or said transparent coat.

3. The photoluminescent golf ball as defined in claim 1, wherein the photoluminescent golf ball has a three-piece structure consisting of a core, an inner cover enclosing the core, an outer cover provided with a number of dimples, and a transparent coat comprising a transparent primer layer and a clear top coat applied to the outer cover, and the photoluminescent compound is contained in one of the outer cover, the primer layer, or the clear top coat layer.

4. The photoluminescent golf ball as defined in claim 2 wherein the encapsulated photoluminescent composition is contained in the cover in an amount of about 0.1 parts per hundred to about 5.0 parts per hundred.

5. The photoluminescent golf ball as defined in claim 2 wherein the encapsulated photoluminescent composition is contained in one of the primer coats or the clear top coat in an amount of about 0.1 parts per hundred to about 5.0 parts per hundred.

6. A golf ball comprising:

a core;

an outer cover surrounding said core, said outer cover defining a plurality of dimples;

a primer coat applied to an exterior surface of said outer cover;

a clear top coat applied to said primer coat;

a photoluminescent pigment being present in at least one of said outer cover, said primer coat, or said clear top coat, said photoluminescent pigment being encapsulated within a wall material of maleic anhydride-grafted polypropylene and the photoluminescent pigment contained within the wall material being selected from the group consisting of a photoluminescent composition comprising 55–62.5 wt % of strontium oxide, 35–42.5 wt % of an aluminum oxide $Al_2O_4$, 1–9 wt % of dysprosium oxide and 0.5–1.5 wt % of europium oxide plus 0.02–0.06 mol % of dysprosium and 0.001–0.005 mol % of nickel; a photoluminescent composition comprising 20–68.75 wt % of strontium oxide, 30–78.75 wt % of an aluminum oxide $AL_2O_4$, 1–49.75 wt % of calcium oxide, 0.1–49.75 wt % of dysprosium oxide, 0.1–49.75 wt % of europium oxide and 0.05–48.8 wt % of silicon dioxide plus 0.02–0.06 mol % of dysprosium and 0.001–0.005 mol % of nickel; and a photoluminescent composition comprising 70–98.85 wt % of calcium sulfide, 1–29.85 wt % of calcium sulfate, 0.05–28.9 wt % of europium oxide and/or thulium oxide, and 0.1–28.95 wt % of silicon dioxide plus 0.02–0.06 mol % of dysprosium and 0.001–0.005 mol % of nickel;

wherein, when the golf ball is exposed to visible light, exposed surfaces of the golf ball are photoluminescent.

7. The golf ball according to claim 6 wherein said photoluminescent pigment is present in said outer cover, said photoluminescent pigment providing visible luminescence for eight hours following activation with a light source.

8. The golf ball according to claim 6 wherein when said photoluminescent pigment is in said outer cover, said photoluminescent pigment is present in a concentration of about 3.0 parts per hundred to about 5.0 parts per hundred of the said outer cover composition.

9. The golf ball according to claim 6 wherein when said photoluminescent pigment is present in either said primer coat or said clear top coat, said photoluminescent pigment having a concentration of about 0.1 to about 3.0 parts per hundred of the coating composition.

10. The golf ball according to claim 6 wherein said golf ball further defines an insignia pad printed on a surface of said golf ball, said insignia having increased visibility when the golf bail is exhibiting luminescence.

* * * * *